US011719389B2

(12) United States Patent
Dufour et al.

(10) Patent No.: US 11,719,389 B2
(45) Date of Patent: Aug. 8, 2023

(54) MOBILE BACKFEEDING INSTALLATION

(71) Applicant: GRTGAZ, Bois Colombes (FR)

(72) Inventors: Daniel Dufour, Bois Colombes (FR); Francis Bainier, Bois Colombes (FR); Marc Vanbaleghem, Bois Colombes (FR); Alban Sesmat, Bois Colombes (FR); Gérard Cattoen, Bois Colombes (FR)

( * ) Notice: Subject to any disclaimer, the term of this patent is extended or adjusted under 35 U.S.C. 154(b) by 394 days.

(21) Appl. No.: 17/252,304

(22) PCT Filed: Jun. 17, 2019

(86) PCT No.: PCT/FR2019/051472
§ 371 (c)(1),
(2) Date: Dec. 15, 2020

(87) PCT Pub. No.: WO2019/239082
PCT Pub. Date: Dec. 19, 2019

(65) Prior Publication Data

US 2021/0270424 A1 Sep. 2, 2021

(30) Foreign Application Priority Data

Jun. 15, 2018 (FR) ..... 1855291

(51) Int. Cl.
*F17D 3/01* (2006.01)
*F17D 1/04* (2006.01)
(Continued)

(52) U.S. Cl.
CPC ..... *F17D 3/01* (2013.01); *F17D 1/04* (2013.01); *F17D 1/07* (2013.01); *F17D 3/10* (2013.01)

(58) Field of Classification Search
CPC ..... F17D 3/01; F17D 3/10; F17D 1/04; F17D 1/07
(Continued)

(56) References Cited

U.S. PATENT DOCUMENTS 1,718,178 A * 6/1929 Oliphant ..... F04F 1/02 417/236
7,624,770 B2 12/2009 Boyd et al.
(Continued)

FOREIGN PATENT DOCUMENTS

DE 102009038128 A1 2/2011
FR 3001523 A1 1/2013
(Continued)

OTHER PUBLICATIONS

ISR; European Patent Office; Netherlands; Oct. 24, 2019.
(Continued)

*Primary Examiner* — Minh Q Le
(74) *Attorney, Agent, or Firm* — Patshegen IP; Moshe Pinchas

(57) ABSTRACT

The invention relates to a backfeeding installation (30) which comprises:
- modules (31 to 35 and 37) comprising the following functions:
  - at least one compressor for compressing gas,
  - an automaton for controlling the operation of at least one compressor,
  - at least one sensor for checking the quality compliance of the gas circulating in the compressor,
  - at least one meter for metering a flow rate of gas circulating in the compressor, and
  - at least one filter for filtering the gas circulating in the compressor; and
- an interconnection module (36A, 36B) for interconnection between the other modules and with a gas network (Continued)

(15) at a first pressure and a gas network (10) at a second pressure higher than the first pressure.

At least one of these modules is mobile and configured to be transported, in its entirety and operational by means of a removable connection to the interconnection module and to a power source, on a single vehicle.

20 Claims, 9 Drawing Sheets

(51) Int. Cl.
*F17D 1/07* (2006.01)
*F17D 3/10* (2006.01)

(58) Field of Classification Search
USPC ..... 137/2, 259, 899.4, 565.17, 14; 141/11, 141/98; 62/50.6
See application file for complete search history.

(56) References Cited

U.S. PATENT DOCUMENTS 8,303,261 B1* 11/2012 Hawkins ..... F04B 35/002 417/364
2006/0144446 A1* 7/2006 Inagaki ..... C01B 17/69 137/565.17
2011/0073202 A1* 3/2011 Feingold ..... F04B 45/04 137/565.17
2013/0000742 A1* 1/2013 Maier ..... H01M 8/04201 137/557
2013/0030577 A1* 1/2013 Jarrell ..... F17D 5/005 700/282
2014/0261784 A1* 9/2014 Watkins, II ..... F23N 1/022 137/495
2015/0240996 A1 8/2015 Kapoor
2020/0188624 A1* 6/2020 Nelson Mock et al. ..... A61M 16/104
2020/0240590 A1* 7/2020 Ortiz ..... F17D 3/01
2020/0370990 A1* 11/2020 Chang ..... G05D 7/0635
2021/0254790 A1* 8/2021 Dufour ..... F17D 1/07
2021/0270425 A1* 9/2021 Dufour ..... F17D 1/07
2021/0285605 A1* 9/2021 Dufour ..... F17D 3/01

FOREIGN PATENT DOCUMENTS

FR 3007417 A1 6/2013
FR 3035598 A1 4/2015

OTHER PUBLICATIONS

Winnard; IFI Capacity Enhancement Project MP To IP Network Compression Oct. 17, 2012.
"The Power Pioneers Bio-Natural Gas Plant Emmertsbuh Feeding Biogas Into the Natural Gas Grid Emmertsbuhl" Darocha; Apr. 27, 2012.

* cited by examiner

MOBILE BACKFEEDING INSTALLATION

TECHNICAL FIELD

The present invention relates to a mobile backfeeding installation. It applies, in particular, to gas transport networks for exporting oversupplies of renewable natural gas from a distribution network to a transport network, which has a much larger storage capacity.

STATE OF THE ART

Biogas production is growing rapidly in Europe. The added value it brings underpins the creation of a sustainable anaerobic digestion industry. Hereinafter, the term "biomethane" means the gas produced from the raw biogas obtained from the anaerobic digestion of organic waste (biomass) or by high-temperature gasification (followed by methanation synthesis), which is then cleaned and treated so that it becomes interchangeable with the natural gas of the network.

While the most common method of adding value is the generation of heat and/or electricity, its utilization as a fuel and the injection of biomethane into the natural gas network are also being developed.

The injection of biomethane into the natural gas network is already taking place in Europe. Against a background of the rapid development of biomethane, the natural gas distributors are faced with situations in which there is a shortage of outlets. This is because consumption by domestic customers over the public distribution systems varies on average from 1 to 10 between winter and summer. The injection of biomethane is initially possible only if it is done at a flow rate less than the minimum flow rate recorded during the periods of lowest consumption, or if the biomethane is produced as close as possible to where it is consumed. When production exceeds the quantities consumed, this tends to saturate the distribution networks during warm seasons. This situation limits the development of the biomethane production industry through the congestion of the natural gas distribution networks. Several solutions have been identified to solve this problem: the interconnection of distribution networks to increase the consumption capacities for the biomethane produced by increasing the number of consumers connected; adjusting biomethane production according to the seasons and consumption needs; microliquefaction and compression for storing biomethane production during periods of low consumption; the development of uses for the gas (in particular, for mobility); and the production of backfeeding units between the natural gas distribution and transport networks.

Backfeeding installations are therefore one of the solutions identified for developing biomethane injection capacities. These installations make it possible to export oversupplies of biomethane from a distribution network to the transport network, by compressing and reinjecting them into this transport network to benefit from its much larger gas storage capacity. Consequently, the producers would no longer have to limit their production and the profitability of their projects would be guaranteed more easily. The backfeeding unit is a structure of the transport operator that allows gas to be transferred from the distribution network to the transport network having a larger storage capacity, via a gas compression station. The backfeeding unit can be located either in the vicinity of the pressure reducing station or at another location where the transport and distribution networks cross.

Backfeeding therefore includes a function of compressing the gas to adapt it to the constraints imposed by the downstream of this compressor, i.e. the transport network. Current backfeeding units are stationary installations in which the compressors are placed inside buildings. There, each compressor is driven by an electric motor connected to the electricity grid.

For financial reasons, some backfeeding units are equipped with only one compressor ensuring 100% of the flow rate. Consequently, these backfeeding units do not ensure a normal operation if the single compressor fails. But the installation of a second compressor ensuring 100% of the flow rate, to provide backup if a stationary backfeeding unit fails, is a costly solution. If a backfeeding unit fails, the biomethane producers can therefore no longer supply their biomethane production. Similarly, if a new biomethane supplier is connected without the prior installation of a backfeeding unit that thus becomes necessary, the biomethane producers are penalized. Similarly, the need for a backfeeding unit may be ad-hoc, or investment in such a backfeeding unit could be postponed, especially pending connections by other biomethane producers, with the same consequences for this industry.

In addition, distribution network configurations evolve, especially when a biogas supplier connects to it and injects biogas into it, or disconnects from it. At the same time, gas consumption in this distribution network can increase or decrease, for example when a consuming factory or large store is installed or when it stops. Therefore, the backfeeding unit can have excess or insufficient capacity, either momentarily or permanently.

More generally, the existing backfeeding installations do not allow their sizing to evolve in line with need.

Current backfeeding units are stationary installations where the compressors are placed inside buildings. Therefore, the current backfeeding units do not enable speedy, flexible intervention on the networks.

DESCRIPTION OF THE INVENTION

The present invention aims to remedy all or part of these drawbacks.

The present invention relates to a backfeeding installation comprising:

- modules comprising the following functions:
  - at least one compressor for compressing gas,
  - an automaton for controlling the operation of at least one compressor,
  - at least one sensor for checking the quality compliance of the gas circulating in the compressor,
  - at least one meter for metering a flow rate of gas circulating in the compressor, and
  - at least one filter for filtering the gas circulating in the compressor; and
- at least one interconnection module for interconnection between the other modules, and with a gas network at a first pressure and a gas network at a second pressure higher than the first pressure, in which at least one of these modules is mobile, configured to be transported, in its entirety and operational by means of a removable connection to the interconnection module and to a power source, on a single vehicle.

Thanks to these provisions, a stationary backfeeding installation can be easily supplemented by a mobile module to increase its compression capacity or to stand in for a stationary element that has broken down, is undergoing maintenance or is being updated. Therefore, during a temporary increase in the compression needs of the backfeeding installation (short-term overcapacity of the biogas producers, short-term reduction in consumption by gas consumers), an additional mobile compressor module is added to the backfeeding installation. Then it is removed once this temporary increase ceases.

The purpose of the mobile backfeeding installation that is the subject of the invention is to address the following three goals in particular:

- provide a mobile backup and greater availability if an already existing mobile backfeeding installation breaks down;
- offer the possibility of postponing an investment in a stationary backfeeding installation;
- offer a temporary solution in an emergency (need or delay); and
- respond to needs that are ad-hoc or too low to justify investment in a stationary backfeeding installation. This therefore makes it possible to strengthen the growth in injection capacities already initiated by the stationary backfeeding installations and therefore to maximize the acceptance of biomethane injection projects.

In some embodiments, all modules of the backfeeding installation are mobile, configured to be transported, in their entirety and operational by means of a removable connection to the interconnection module and to a power source, on a single vehicle.

Thanks to these provisions, temporary backfeeding needs, for example pending the installation of a stationary backfeeding installation, can be met by a mobile backfeeding installation.

In some embodiments, the backfeeding installation comprises a mobile stand-alone electric power source.

Thanks to these provisions, the mobile backfeeding installation does not need to be connected to the power grid to work.

In some embodiments, the mobile electric power source is a generator put into operation by a vehicle motor.

Thanks to these provisions, the same motor can be used to actuate different modules, or to propel the vehicle.

In some embodiments, the electric power source is a motor fueled with gas at the first pressure. Thanks to these provisions, the primary energy source is the gas to be compressed, which avoids having to transport this primary energy.

In some embodiments, at least one module comprises a gas detector and/or a fire detector.

Thanks to these provisions, the safety of the mobile backfeeding installation is ensured by at least one of the modules it comprises.

In some embodiments, at least one compressor is actuated mechanically by a vehicle motor.

Thanks to these provisions, the same motor can be used to actuate the compressor and to propel the vehicle.

In some embodiments, the interconnection module also comprises:

- a mobile distribution unit for distributing gas from a gas network at a first pressure to several modules by means of an interface; and
- a mobile collection unit for collecting the gas from each said module at a second interface.

Thanks to these provisions, the gas flows between the different modules are easily established for operating a backfeeding installation.

In some embodiments, the automaton is configured to control the operation of a plurality of compressors as a function of the compression capacity of the operational compressors.

Thanks to these provisions, the compression capacities of the backfeeding installation can evolve easily. A compressor module can be easily installed or removed in this installation.

In some embodiments, the backfeeding installation also comprises at least one recycling circuit equipped with a valve, configured to expand the gas exiting from a compressor and inject it upstream from or at the inlet of said compressor, the automaton being configured to control the operation of the valve of the recycling circuit as a function of the compression capacity of the operational compressors that are put into operation jointly.

Thanks to these provisions, the stability of the distribution network is ensured, regardless of the operational compression capacity of the compressors put into operation jointly, i.e. simultaneously or with a reduced time lag.

In some embodiments, at least one module of the backfeeding installation is incorporated into a standard container.

In some embodiments, at least one module of the backfeeding installation is mounted on a vehicle.

Thanks to each of these provisions, transporting this module is made easier.

In some embodiments, at least one compressor is actuated mechanically by a motor of the vehicle.

In some embodiments, at least one module of the backfeeding installation is supplied with electrical power by a generator mounted on the vehicle.

Thanks to each of these provisions, the actuation of the compressor requires no oversizing of the electrical power supply of the backfeeding installation, relative to the supply for stationary compressors on their own.

In some embodiments, the backfeeding installation comprises a mobile analysis laboratory that is air-conditioned and protected from shocks and vibrations, this laboratory including a shared chromatograph to measure the THT and the composition of the gas.

Thanks to these provisions, a single chromatograph allows several measurements to be made.

In some embodiments, the backfeeding installation comprises a correlation calorimeter utilizing the gas composition obtained by a chromatograph.

In this way, the heating value of the gas is measured indirectly and at a low cost.

In some embodiments, the backfeeding installation comprises a hygrometer, for example a ceramic hygrometer.

As this hygrometer is less sensitive to vibrations than other types of hygrometer, the design of the mobile backfeeding installation is made easier.

In some embodiments, the backfeeding installation comprises a dehydration skid and a volumetric meter.

In some embodiments, the backfeeding installation comprises a means for valve-control in series, downstream from at least one compressor.

In some embodiments, the backfeeding installation comprises a discharge device in series, downstream from at least one compressor.

The valve-control means and the discharge device facilitate the operation of the compressor, especially when it is started up.

In some embodiments, the backfeeding installation comprises a system for storing gas in bottles, and a means for sampling the gas at different times, for example using pneumatic valves.

Thanks to these provisions, the composition of the gas can be determined at a later time, which reduces the production cost of the installation, compared to a built-in chromatograph.

In some embodiments, the backfeeding installation comprises a fire control unit, with detector and extinguisher, and a means for detecting gas.

In some embodiments, the backfeeding installation comprises an electrical cabinet isolated from each compressor by a wall comprising sealed bulkhead fittings.

Thanks to these provisions, the safety of the installation is strengthened.

BRIEF DESCRIPTION OF THE FIGURES

Other advantages, aims and characteristics of the present invention will become apparent from the description that will follow, made, as an example that is in no way limiting, with reference to the drawings included in an appendix, wherein.

DESCRIPTION OF EMBODIMENTS OF THE INVENTION

Figure 1:
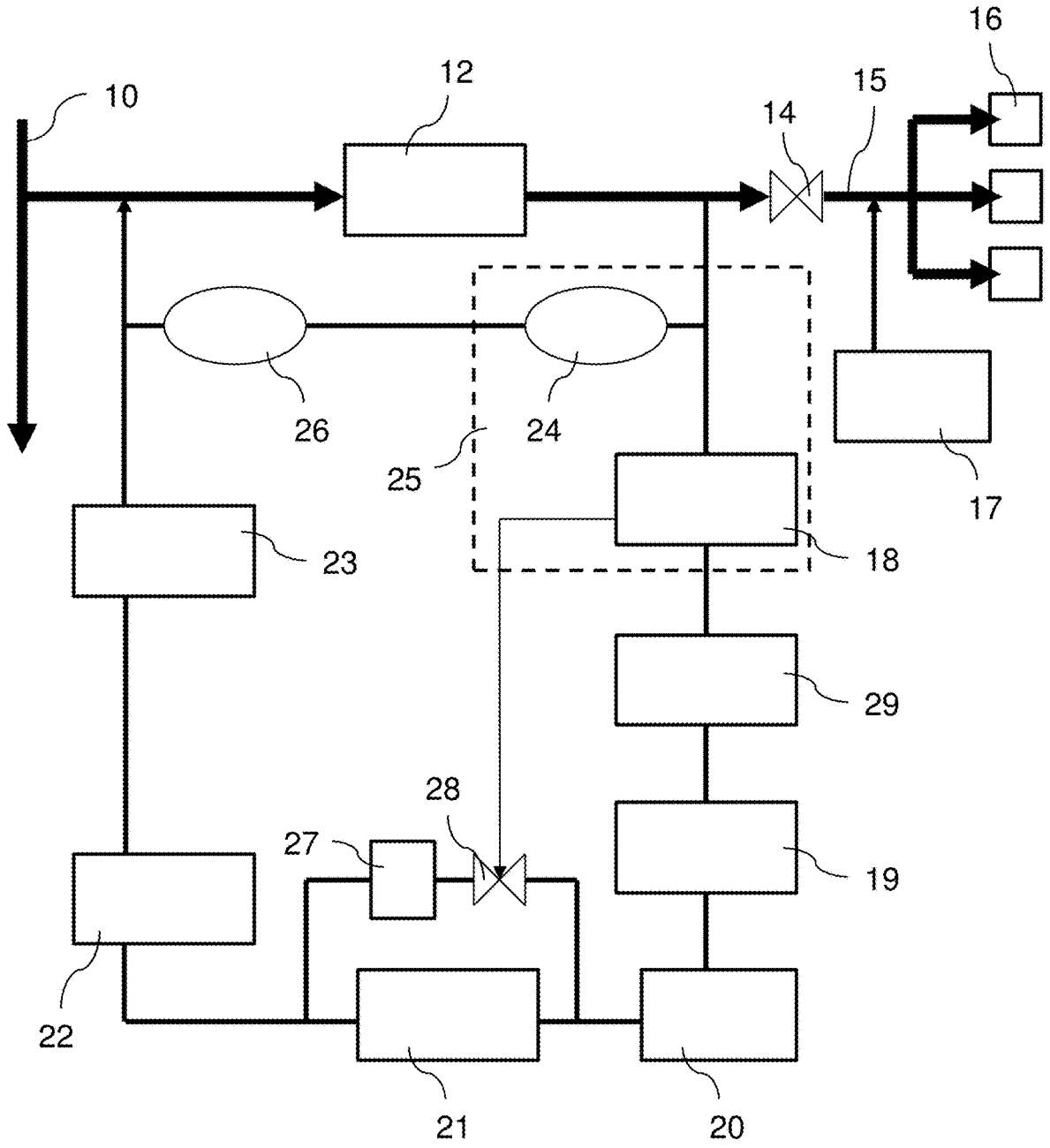
FIG. 1 represents, in the form of a block diagram, a backfeeding installation known in the prior art.

FIG. 1 represents, schematically, the principle of a backfeeding installation known in the prior art. The backfeeding installation has a set of technical functions making it possible to create a flow of gas by controlling the operating conditions specific to a transport network 10 and a distribution network 15. These functions comprise:

- processing and verifying 19 the quality compliance of the gas with the technical specifications of the transport operator;
- metering 20 the quantities transferred;
- compressing the gas from the distribution network 15, by at least one compressor 21, this consists generally of electrically-driven or piston compressors, with two or three compression stages;
- regulating 24 the pressure or flow rate;
- filtering 22, upstream and downstream;
- managing 18 the stability of the operation of the distribution network;
- the safety devices 26; and
- the tools 24 for managing and monitoring the backfeeding installation.

These various functions are described below. In addition, there are the utilities (electrical sources, communication network, etc.) necessary to operate an industrial facility. The backfeeding installation is sized taking into account:

- the operating pressure of the transport network 10 and of the distribution network 15. The first must be between 30 and 60 bar over the regional network, and can reach 85 bar over the main network. The second is 4 to 19 bar over the MPC networks (Medium Pressure Network type C, i.e. pressure between 4 and 25 bar) and less than 4 bar over the MPB networks (Medium Pressure Network type B, i.e. pressure between 50 millibar and 4 bar);
- the maximum production capacity of the biomethane producers 17 likely to inject biomethane into the distribution network 15, a capacity that varies by several tens of $Nm^3/h$ for the smallest units, to several hundreds of $Nm^3/h$ for the largest;
- the consumption of consumers 16 over the distribution network 15, especially the minimum consumption; and
- the ability of the distribution network 15 to absorb variations in pressure (water volume).

All of this data makes it possible to determine the maximum flow rate of the backfeeding installation and to estimate its operating time. This can vary, depending on the case, from an occasional operation (10-15% of the time) to an almost-permanent operation. This exercise must also include the fact that the installations of the producers 17 are put into service over the years, not simultaneously.

With regard to the analysis 19 of the gas conformity, differences exist between the gas quality specifications applied to the transport 10 and distribution 15 networks, because of the different operating pressures, infrastructure, materials, uses and interfaces with the underground storage sites. The specifications of the transport networks 10 are generally more stringent than those of the distribution networks 10. Therefore, to ensure that the gas backfeeding installation from the distribution network 15 to the transport network 10 is consistent with operations in the transport network 10, the following provisions are provided:

- a dehydration unit 29 upstream of the compression 21, to reduce the condensation risks on the high-pressure transport network, the formation of hydrates and corrosion,
- optionally, a laboratory for analyzing combustion parameters (Wobbe index, heating value and density of the gas), for injecting the samples in the energy determination system of the transport operator.

At the transport operator's discretion, the analysis of other levels of compounds ($CO_2$, $H_2O$, THT, etc.) is optional, and is only carried out if there is a proven risk of contamination of the transport network 10 (for example, backfeeding biomethane with a high $CO_2$ content with no possibility of dilution over the distribution 15 and transport 10 networks, or operation at a very high pressure).

For the gas metering 20, the backfeeding installation is equipped with a measurement chain made up of a meter and a local or regional device for determining the energy per the legal metrology.

With regard to the gas compression, the compression unit enables the surplus biomethane production to be compressed to the operating pressure of the transport network 10. There are several possible configurations, depending on the economic criteria and availabilities of the installation, such as:

- one compressor 21 providing 100% of the maximum backfeeding need;
- two compressors 21, each providing 100% of the maximum backfeeding need; or
- two compressors 21, each providing 50% of the maximum backfeeding need.

The configuration is chosen by examining the various advantages and drawbacks in terms of costs, availability, dimensions, and scalability of the compression unit. The suction pressure to be considered is the operating pressure of the distribution network 15, which depends in particular on the injection pressures of the biomethane producers 17. The discharge construction pressure to be considered is the maximum operating pressure ("MOP") of the transport network, for example 67.7 bar. To perform the starting phase, the anti-surge protection system of each compressor 21 (other than piston compressors) or the stabilized operation in recycling mode, a recycling circuit 27 equipped with a valve 28 can be provided. The recycling circuit expands the gas to the second pressure and injects it upstream from or at the inlet of the compressor when at least one compressor is put into operation, under the control of the automaton 25.

The impermeability of each compressor 21 can be achieved with oil or dry packing. In the first case, certain filtering provisions are implemented (see below).

An automaton 25 performs the functions of management 24, control of each compressor, and regulation and stability 18 of the network 15. Note that, throughout the description, the term "automaton" means a PLC or computer system, or a set of PLCs and/or computer systems (for example one PLC per function).

With regard to regulation, the change in the pressure of the distribution network 15 in the vicinity of the backfeeding installation is correlated to the flow rate of the gas passing through the backfeeding installation. These changes are the result of the dynamic nature of gas consumption over the distribution network 15, capacities of biomethane injected by the producers 17 and the operation of the delivery installation, by means of a valve 14, and backfeeding installation. This therefore incorporates possibilities to adapt the operating range for the suction pressure of the backfeeding installation, and also a regulation of the compressors 21 that can anticipate the constraints operating over the distribution network 15, depending on the configurations encountered. This differs from delivery stations without backfeed, for which the pressure is regulated at the delivery point so as to be fixed, regardless of the consumption by the consumers 16. Consequently, the regulation mode (pressure or flow rate) of the backfeed flow towards the transport network 10 is adapted to the correct operation of the backfeeding installation.

Depending on the specifications of the compressors, and to prevent their deterioration or because of the constraints linked to the operation of the transport network 10, filtering is envisaged in the gas quality compliance function, upstream from the compression so as to collect any liquid and the dust contained in the gas from the distribution network 15. In addition, in the case of an oil-sealed compressor 21, a coalescing filter 22 is installed at the outlet from the compressor 21, for example with manual venting and a gauge glass.

A cooling system 23 cools all or part of the compressed gas to maintain the temperature downstream, towards the transport network 10, at a value below 55° C. (certification temperature of the equipment). To ensure the operation of the cooling system 23, it is sized using relevant ambient temperature values based on meteorological records.

The delivery station 12 is an installation, located at the downstream end of the transport network, which enables the natural gas to be delivered according to the needs expressed by the customer (pressure, flow rate, temperature, etc.). Therefore, this concerns the expansion interface for the gas from the transport network 10 to the distribution network 15 or to certain industrial installations. The delivery station 12 therefore incorporates expansion valves to reduce the pressure in order to adapt to the conditions imposed downstream.

To prevent instability phenomena, the backfeeding installation must not operate simultaneously with the expansion and delivery station 12 from the transport network 10 to the distribution network 15. Threshold values for the starting and stopping of the backfeeding installation are set accordingly, and each automaton 25 of an installation combining expansion 12 and backfeed is adapted to prohibit the simultaneous occurrence of these two functions. The backfeeding installations, during their starting, operation and stopping phases, limit the disruptions in the upstream network (distribution 15) and downstream network (transport 10) by, in particular, preventing the pressure safety measures of the delivery station 12 from being triggered. The following parameters are taken into account:

- number of starting and stopping cycles of each compressor 21 and its compatibility with the recommendations of the supplier of the compressor 21;
- the starting and stopping of each compressor 21 by a routine, following a time delay;
- the use of a buffer volume (not shown) upstream from each compressor 21, to level out pressure and flow rate variations of the distribution network 15.

A management and monitoring function performed by the automaton 25 makes it possible to obtain:

- an automatic operation mode;
- display/monitoring of the operation of the backfeeding installation; and
- the starting of the backfeeding installation.

Data historization is carried out to confirm the operating conditions.

In an emergency, the backfeeding installation is isolated from the distribution network 15 by closing the valve 14. An "emergency stop" function allows the backfeeding installation to be stopped and made safe. The backfeeding installation is also equipped with pressure and temperature safety devices 26. There is no automatic venting unless contraindicated in the safety studies. The backfeeding installation is equipped with gas and fire detection systems 26. A means for protection against excess flows is provided to protect the devices, in the form of a physical component such as a restrictor hole or by means of an automaton.

Note that the flow rate of a backfeeding unit can vary from several hundred to several thousand $Nm^3/h$, depending on the case.

Figure 2:
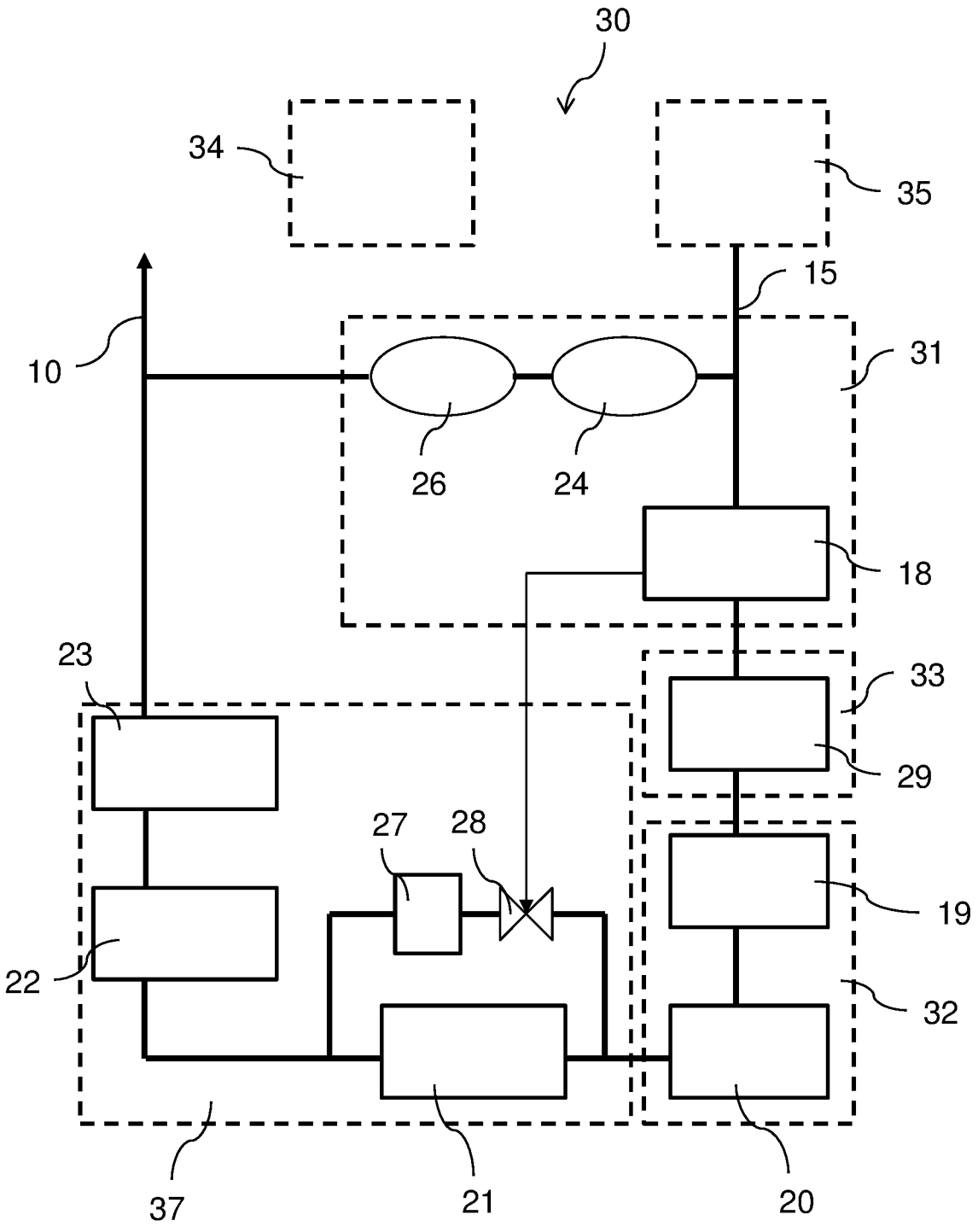
FIG. 2 represents, in the form of a block diagram, a backfeeding installation that is the subject of the invention.

FIG. 2 represents a particular embodiment of a scalable backfeeding installation 30 that is the subject of the invention. It includes the functions shown in FIG. 1, grouped together in modules:

- module 37 groups together the compression 21, filtering 22, cooling 23 and recycling 27 and 28 functions;
- module 31 groups together the safety 26, management 24 and network stability 18 functions;
- module 32 groups together the gas quality compliance verification 19 and metering 20 functions; and
- module 33 comprises the dehydration function 29.

Two modules are added to this set of modules:

a module 34 comprises the utility functions, in particular electrical power supply; and a module 35 comprises a buffer tank to store gas from the distribution network upstream from the compression and thus limit the transient effects during the initiation of the compression.

The relationships of module 34 with the other modules are not shown in FIG. 2, for reasons of clarity. It is noted, however, that module 34 supplies electrical power to all the other modules that consume it.

The six different modules thus group together the components with the same functionality of a backfeeding installation:

the compression module 37, for the gas compression function in the event of a breakdown of the stationary compressor. The compressor is either driven by the motor of the truck that transports or tows it, or driven by an electric motor powered by the electrical power supply module or by the electricity grid of the existing site. So as to adapt to a large range of flow rates, several compression modules can be connected in parallel via an interconnection module;

the automation module 31, containing a Programmable Logic Controller to acquire all the data required for monitoring the various functional modules, with a human-machine interface making it possible to view the status of the modules and to send commands when the backfeeding unit operates in manual mode;

the instrumentation module 32, containing different gas analyzers—$O_2$, $H_2O$, $CO_2$ and THT—and a transactional metering unit. This module also contains a filter making it possible to separate the solid and liquid particles possibly conveyed by the natural gas of the distribution network;

the dehydration module 33 (optional use), for managing the different water contents of the distribution and transport networks;

the electrical power supply module 34, containing a generator, for supplying the compression module, and an uninterruptible power supply system (batteries with their charger and possibly an inverter) for supplying the command/control of the various modules; and the large-volume buffer tank module 35 (optional use), for ensuring a sufficiently large volume for the suction of the compressor, so as to respect the starting and stopping times of the compression unit; and having a sufficient volume to absorb overpressures in the event of an incident.

Figure 3:
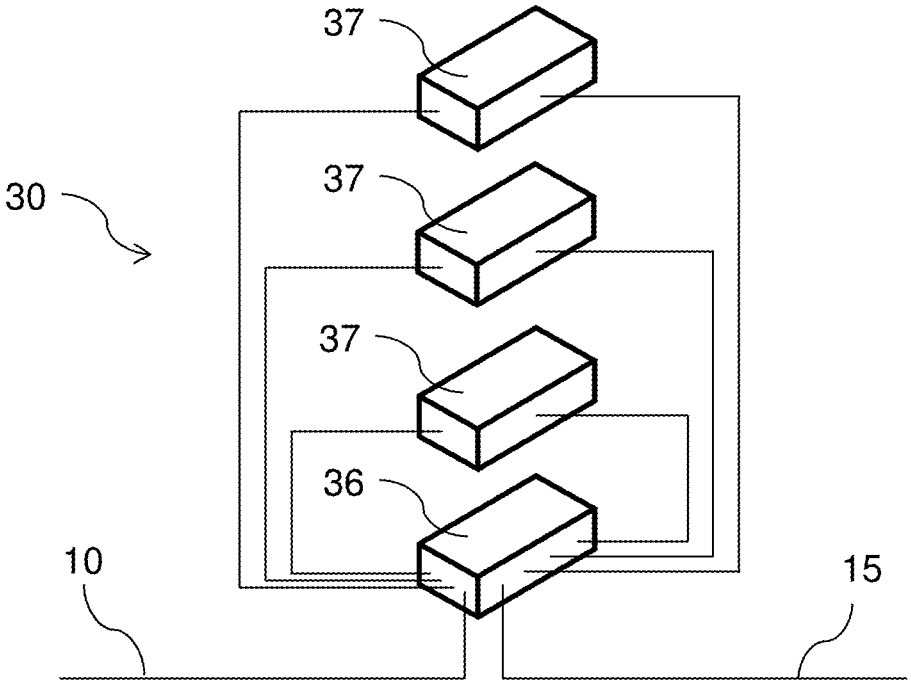
FIG. 3 represents, schematically, the assembly of different modules of a backfeeding installation that is the subject of the invention.

Apart from the large-volume buffer tank module 35, each of these modules is preferably incorporated into a self-contained container, as shown in FIG. 3.

The six modules can be transported by a truck or a truck trailer and can be connected to one another to form a complete mobile backfeeding installation. Each module can also be connected to a stationary backfeeding installation to perform its dedicated function in the event of a breakdown of the stationary equipment. Each module comprises its own safety measures and its own automaton, which makes it autonomous and independent of the other modules, apart from the overall management of the backfeeding installation, the power and the gas supply, where applicable.

As a result, the commissioning of a completely mobile backfeeding installation and the change in capacities for a stationary or mobile backfeeding installation are easy. It is just necessary to connect the different modules, or to add a module to an existing installation.

FIG. 3 shows, connected to the transport network 10 and distribution network 15, an interconnection module 36 which distributes the gas between the compression modules 37. The interconnection module 36 comprises valves and an interconnection grid (see FIG. 8), for connecting the various modules. The interconnection module 36 connects to the networks 10 and 15 by means of an existing flange with a quick-connect coupling. For example, the interconnection module 36 comprises flexible couplings.

Figure 4:
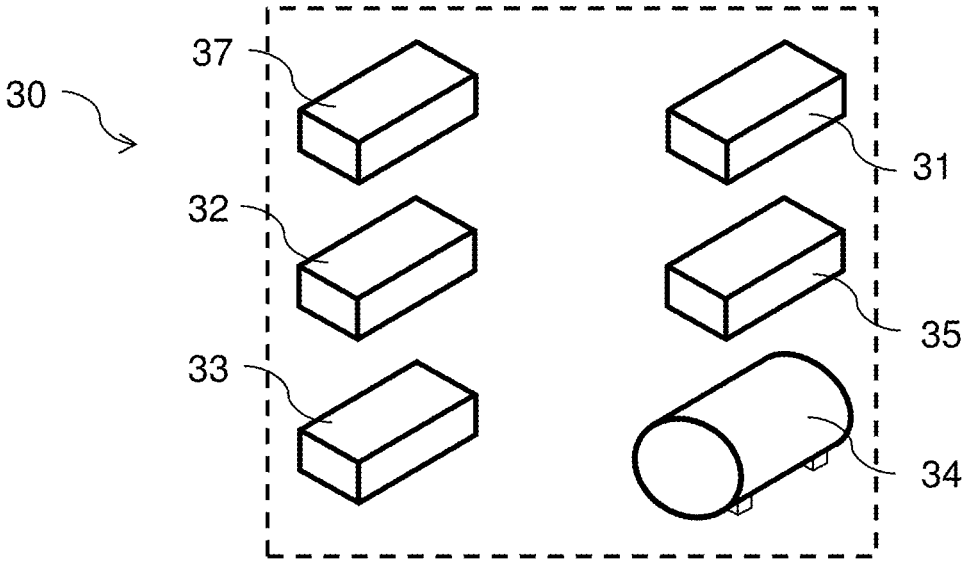
FIG. 4 represents, schematically, modules of a mobile embodiment of a backfeeding installation.

FIG. 4 shows the various modules illustrated in FIG. 2, in the form of standard containers allowing them to be transported on trucks or trailers.

Figure 5:
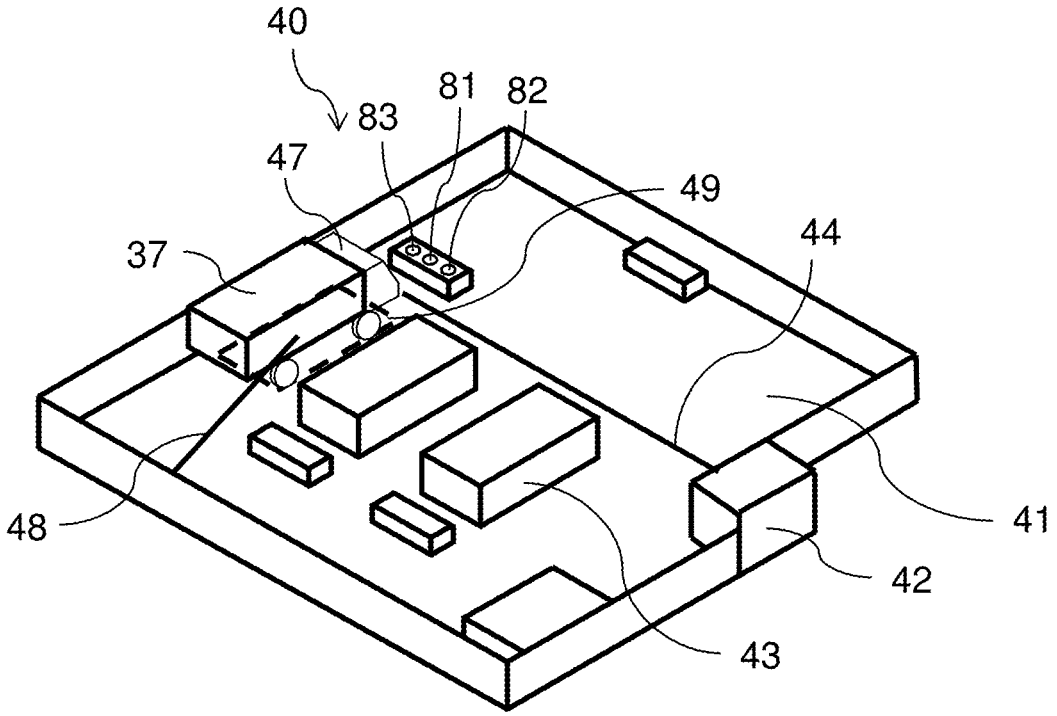
FIG. 5 represents, schematically, a stationary backfeeding installation comprising a mobile module.

FIG. 5 shows a backfeeding installation 40, which comprises a stationary portion in a building, in particular a slab 41 for supporting the various systems, a cabinet 42 comprising the automaton 33, at least one compressor 43, and a cable 44 for the electrical and computer connection of the various systems equipped with sensors and actuators (in particular valves).

In the embodiment shown in FIG. 5, the backfeeding installation 40 comprises at least one dedicated mounting space, or location, 49 for an additional compressor in the vicinity of a free interface of the distribution unit and in the vicinity of a free interface of the collection unit. The utilization of each additional compressor is therefore made easier.

The mounting space 49 is equipped with at least one gas inlet connector 83 at the first pressure, at least one gas outlet connector 81 at the second pressure, and at least one energy supply connector 82 (gas from the distribution network 15 or electricity) for each additional mobile compressor 37. This connector 82 can supply an electric or combustion motor actuating the additional mobile compressor 37 or a vehicle's generator with gas at the first pressure, this generator supplying an electric motor actuating the additional mobile compressor 37.

The lines and electrical power supplies (not shown) are sized for the simultaneous operation of each stationary compressor 43 and of each additional mobile compressor 37. In this way, the backfeeding installation 40 can accommodate each additional compressor without the compressor having to be associated with a power supply and/or additional lines.

FIG. 5 shows the backfeeding installation 40 after connecting an additional mobile compressor module 37 mounted on a vehicle 47 (in this case, a truck or trailer) and connected to the distribution network 15 by a connector 48.

Thanks to the mobility of the additional compressor 37, during a temporary increase in the compression needs of the backfeeding installation 40 (breakdown or short-term overcapacity of the biogas producers, short-term reduction in consumption by gas consumers), the additional mobile compressor 37 is added quickly and easily to the backfeeding installation 40. Then it is removed once this temporary increase ceases.

Because the compressor module 37 is mounted on a vehicle 47 and preferably incorporated into a standard container, transporting the compressor module 37 is made easier.

In some embodiments, the compressor module 37 is mechanically actuated by a motor of the vehicle 47, as described with reference to FIG. 7. To this end, a mechanical linkage, for example with universal joints, connects a shaft of the motor of the vehicle 47, for example its only motor, to a shaft of the compressor. Preferably, the motor actuating the additional compressor 37 is an electric motor or a gas motor using the gas from the line with the lowest pressure of the distribution network 15.

In some embodiments, at least one additional mobile compressor 37 is supplied with electrical power by a generator mounted on the vehicle 47, preferably operating with gas from the line with the lowest pressure of the distribution network 15. Therefore, actuation of the compressor 37 requires no oversizing of the energy supply of the backfeeding installation 40, relative to the supply for stationary compressors 43 on their own.

In the embodiment shown in FIG. 5, the backfeeding installation 40 comprises:

- at least the stationary compressor 43 between the distribution network 15 of gas at a first pressure, and the transport network 10 of gas at the second pressure, and
- the mounting space 49 for at least one additional compressor, which space is equipped with at least one gas inlet connector 83 at the first pressure, at least one gas outlet connector 81 at the second pressure, and, optionally, at least one energy supply connector 82 (gas from the distribution network 15 or electricity) for the additional mobile compressor 37;
- the distribution unit 31 for distributing gas from the gas network at the first pressure to each stationary compressor and to the gas inlet connector at the first pressure for at least one additional mobile compressor 37; and
- the collection unit 32 for collecting gas from each stationary compressor and the gas outlet connector at the second pressure for each additional mobile compressor 37.

The automaton 33 for controlling the operation of each stationary compressor, and each additional mobile compressor 37, is configured to detect the operational stationary and additional compressors, to determine the compression capacity of the operational compressors and to control the operation of each stationary compressor and each additional compressor as a function of the compression capacity of the operational stationary and additional compressors.

In FIG. 5, the mounting space 49 for at least one additional compressor is configured to accommodate a vehicle containing at least one additional compressor. The installation 40 is configured so that the vehicle 47 has driving access from outside the installation to the mounting space 49.

The modular nature of the mobile backfeeding installation that is the subject of the invention means that the transport network operator only has to transport the functionalities that have broken down in the stationary backfeeding installation. Interventions are therefore simpler, and maintenance of the system can be performed for a portion of the equipment, leaving the other portions operational.

Figure 6:
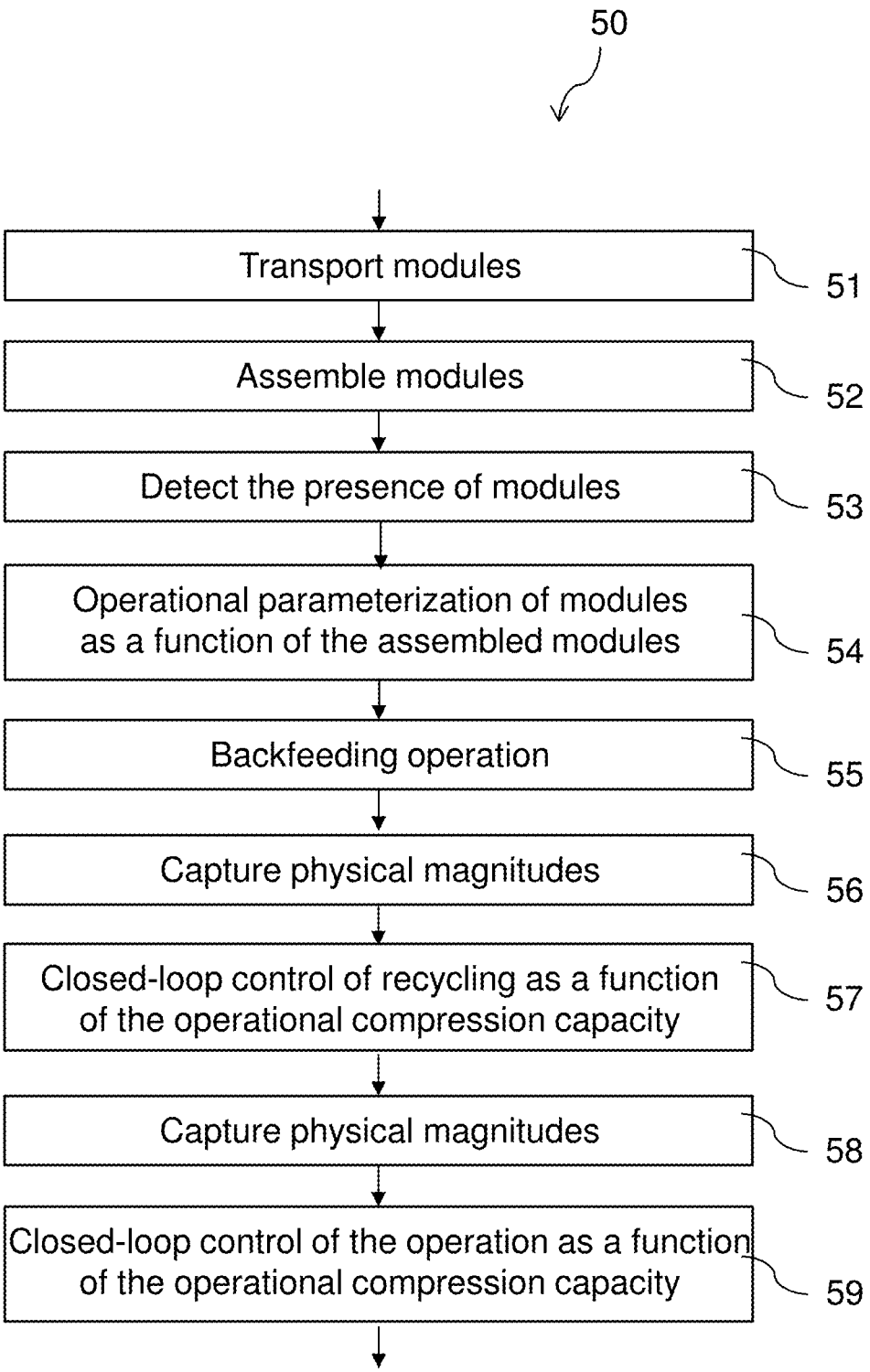
FIG. 6 represents, in the form of a logic diagram, steps for installing and operating a backfeeding installation that is the subject of the invention.

FIG. 6 shows steps of a method for operating a mobile backfeeding installation that is the subject of the invention.

During a step 51, each module is transported to the installation location, for example in the vicinity of a station for expanding the gas from the transport network and supplying the expanded gas to a distribution network.

A mobile backfeeding installation comprises at least the automation module 31, the interconnection module 36 and a compressor module 37. The electrical power supply module 34 is preferable, but it can be replaced by a generator associated to a vehicle motor, as described with reference to FIG. 7.

During a step 52, the connection is realized for the modules, to one another by means of the interconnection module 36, and to the lines of the transport 10 and distribution 15 networks. Therefore, the modules consuming electrical power are connected electrically, and the modules comprising sensors and/or actuators, for example valves, are connected computationally.

During a step 53, the automaton detects the presence of the additional compressor and its compression capacity. This detection can be automatic, for example by detecting the electrical link between the automaton and the motor of the compressor, or manual, with the installation of the compressor being declared by an operator on a user interface of the automaton.

During a step 54, the automaton defines the operational parameterization of the mobile backfeeding installation as a function of the operational compression capacity (i.e. including the compressor module but not taking into account compressors that have broken down or are stopped, e.g. for maintenance or update). The operational parameterization mainly consists of setting:

- threshold values for pressure and other physical magnitudes measured by sensors incorporated into the various devices present in the installation; and
- possibly, values of actuation parameters for valves and other devices, such as delay times or change curves.

During a step 55, the automaton orders the backfeeding installation to be put into operation.

During a step 56, the automaton receives physical magnitudes captured by the sensors of the backfeeding installation, in particular the pressure value at the inlet of each compressor.

During a step 57, the automaton carries out closed-loop control of the recycling circuit as a function of the operational compression capacity. The unitary or combined starting of compressors causes a pressure peak and can lead to maximum operating pressure ("MOP") and minimum pressure (2.5 bar) problems. These risks are avoided by defining threshold values and the recycling circuit (re-expansion) is utilized to provide a gradual ramp-up and stop the transient.

During a step 58, the automaton receives physical magnitudes captured by the sensors of the backfeeding installation, in particular the pressure value at the inlet of each compressor.

Figure 9:
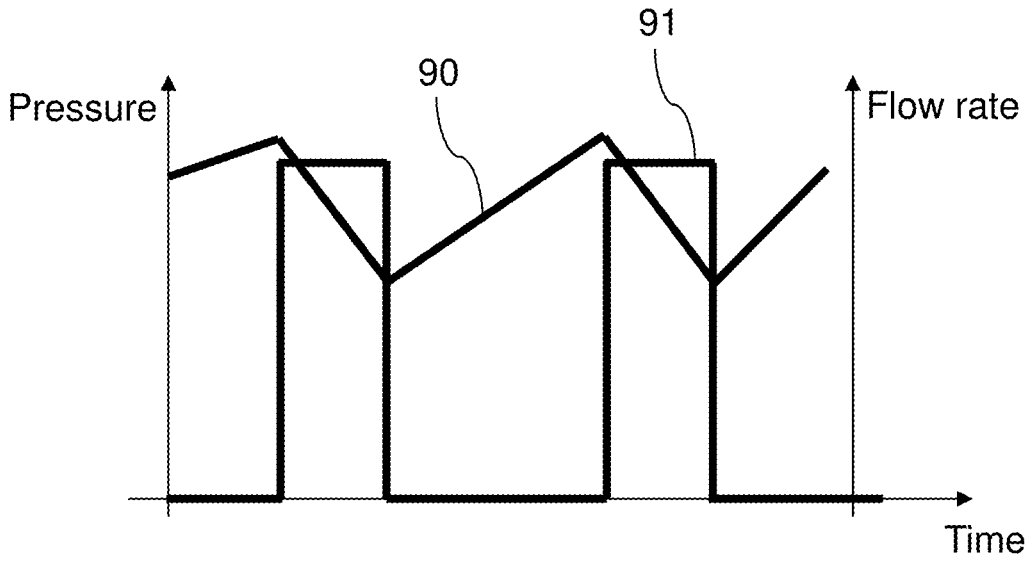
FIG. 9 represents changes in flow rate and pressure during the flow regulation for the backfeeding installation operation.
Figure 10:
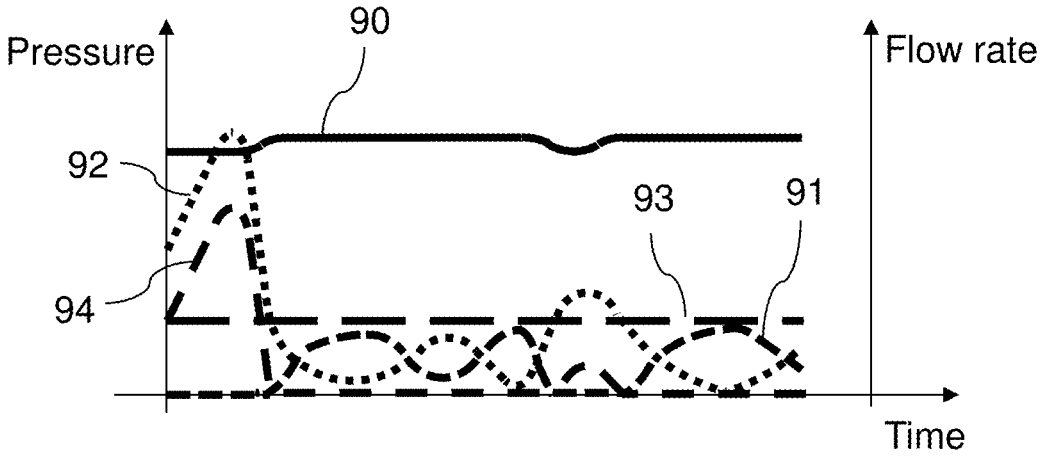
FIG. 10 represents changes in flow rate and pressure during the pressure regulation for the backfeeding installation operation.

During a step 59, the automaton carries out closed-loop control of the stationary operation of the backfeeding installation, until the compressors are stopped (see FIGS. 9 and 10). Then one goes back to step 56 for the next phase of at least one compressor being put into operation.

Figure 7:
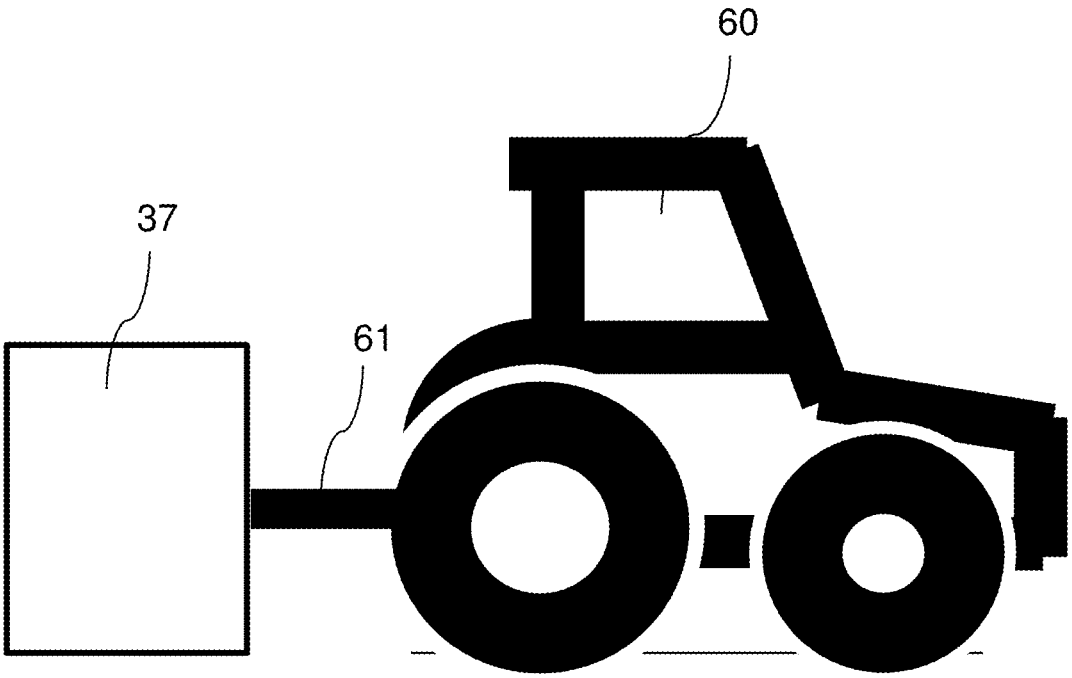
FIG. 7 represents a mechanical interface between a vehicle and a compressor.

As shown in FIG. 7, the compressor 37 and the electrical power supply module can be driven by a stand-alone motor or the motor of a vehicle, in particular a truck or a tractor. In the embodiment shown in FIG. 7, the power take-off shaft of a tractor 60 drives the mobile compressor 37 and supplies the electricity required to the backfeeding installation.

Preferably, to reduce noise pollution, there is a noise barrier (20 dB) and the tractor motor is used at average speed.

The electrical power supply module 34 powered by a vehicle motor is, for example, of the type described in PCT international application WO2013182824.

The mechanical actuation of the compression module 37 can also be performed by the motor of this vehicle.

As can be seen in FIG. 7, removable connection means are arranged on the compression module 37. These removable connection means are configured to temporarily connect the link pin of a compressor to a power take-off 61 of a vehicle 60. Rotation of the power take-off causes the rotation of the link pin and therefore of the shaft of the compressor 37, which enables the compressor 37 to operate. Of course, these removable connection means allow the compression module 37 to be quickly disconnected from the power take-off of the vehicle 60.

As shown in FIG. 7, the removable connection means consist of a drive shaft fitted with universal joints and a torque limiter. A first universal joint is assembled to the link pin and a second universal joint is assembled to the power take-off of the vehicle. These provisions have the advantage of being able to easily transmit the rotation of the vehicle's power take-off to the link pin even if there is an offset between these elements.

In some embodiments, means for closed-loop control comprise, for each vehicle, a potentiometer and a servomotor or equivalent, which acts on the variation of the potentiometer as a function of a setpoint value calculated by the closed-loop control means, the potentiometer being configured to be connected electrically to a computer of the vehicle enabling the rotational speed of a motor of the vehicle to be controlled. In a variant embodiment, the closed-loop control means comprise, for each vehicle, an actuation system configured to mechanically activate a speed pedal of the vehicle, configured to modify the rotational speed of a motor of said vehicle.

In this way, the automation module 31 is connected by means of a control cable to a regulating device, which acts on the motor of the vehicle so as to regulate the rotational speed of the motor and, as a result, to regulate the speed and therefore the rotational frequency of the power take-off, which makes it possible to regulate the compression produced by the compression module 37.

The automation module 31 is therefore programmed to transmit a setpoint to the regulating device, enabling the closed-loop control of the motor. In an embodiment, not shown in detail in the figures, this regulating device consists of a servomotor or an equivalent system, powered by an external electrical source such as a battery, and a potentiometer connected to the servomotor.

This servomotor makes it possible to alter the potentiometer setting to change its resistance value. This servomotor is controlled by the alternator management module. This potentiometer is connected by a connector cable to a computer arranged on the vehicle, the computer making it possible to modify the rotational speed of the motor of the vehicle as a function of the potentiometer's resistance setting. The arrangement of such a computer on a vehicle is known to the person skilled in the art in the vehicles field.

In a variant embodiment, this regulating device consists of an actuation system which comprises a mounting pillar comprising at its lower end a magnetic lock, a prop stationary in the cabin, or a sufficiently heavy base, allowing the actuation system to be assembled temporarily on the floor of the vehicle. A control cylinder is mounted with a pivoting link at its rear end, on the mounting pillar. The piston of the control cylinder has its end mounted with a pivoting link on a control lever, one of whose ends is mounted with a pivoting link to the lower end of the mounting pillar. The second end of the control lever is in contact with a pedal of the vehicle making it possible to modify the rotational speed of the motor and, as a result, the rotational speed of the power take-off. Therefore, by means of the control cable, the automation module makes it possible to command the control cylinder and regulate the speed of the motor.

In a design variant of the removable connection means between the vehicle and the compressor module 37, these can consist of a mechanism for transmission by agricultural universal joint configured to be connected directly or indirectly through a torque limiter to a drive axle of a vehicle such as a truck, car or tractor, for example. It can, for example, consist of two rollers able to receive a wheel of the vehicle. The rotation of the wheel causes the rotation of the wheels, which mesh with and drive a power take-off connected to the shaft of the compressor by a universal joint type of transmission. A part can also be provided that is configured to be engaged on the studs or on the retaining nuts of the wheel of a vehicle, and a lifting system of the vehicle allowing the drive wheels to be lifted, for positioning them out of contact with the ground, said part forming a power take-off that is connected to the shaft of the compressor by a universal joint type of transmission.

Figure 8:
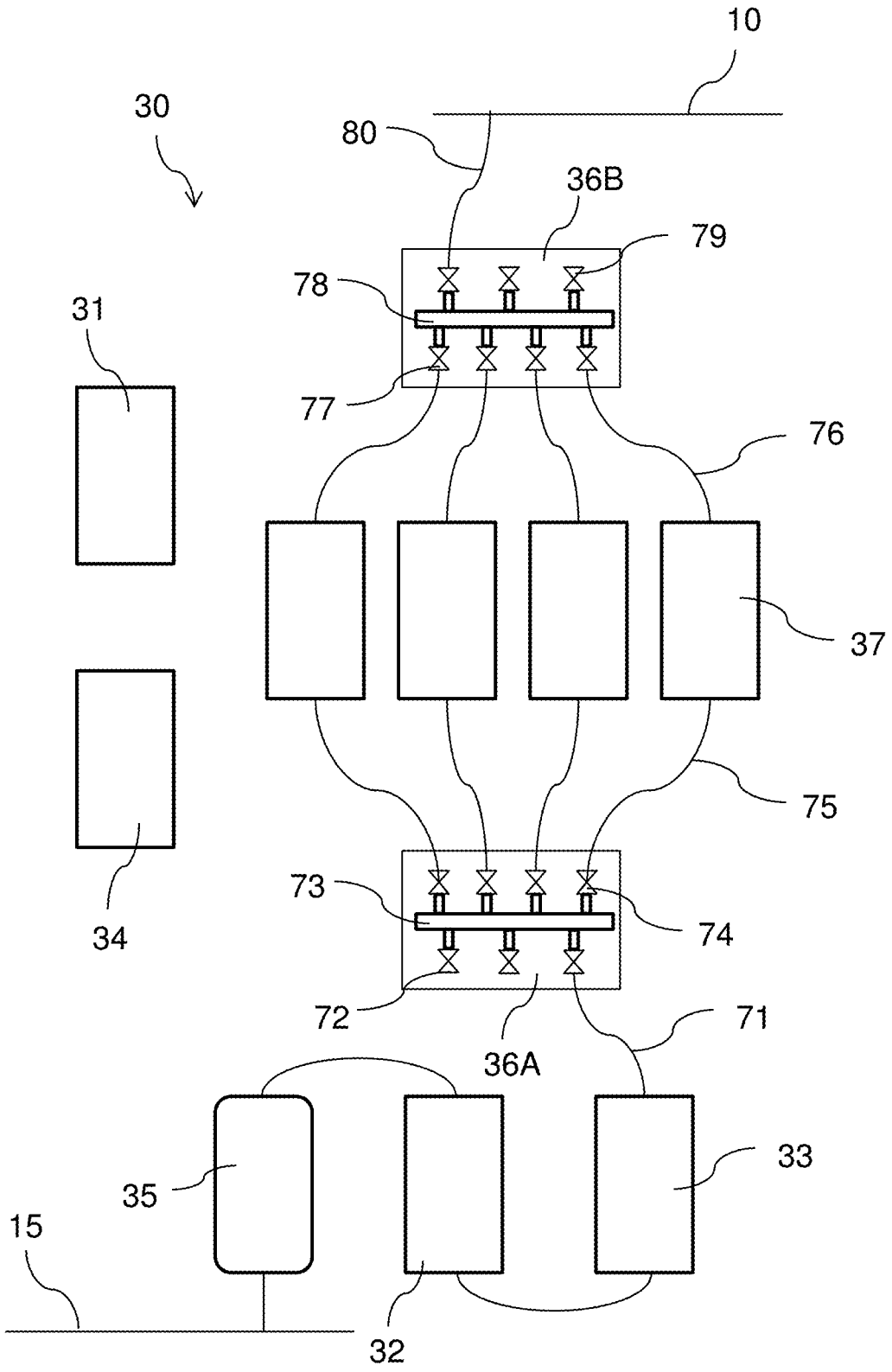
FIG. 8 shows the components of an interconnection module in a complete mobile backfeeding installation.

FIG. 8 shows a mobile backfeeding installation 30, between a gas transport network 10 and a gas distribution network 15. The gas from the network 15 circulates first through the buffer tank module 35 then through the gas quality compliance verification and metering module 32, the dehydration module 33, a quick-release hose 71 and a first portion 36A of the interconnection module 36. This first portion 36A comprises inlet valves 72, a gas suction feeder tank 73 and outlet valves 74. Flange hoses 75 connect each outlet valve 74 to the inlet of a compressor module 37. Each outlet of a compressor module 37 is connected, by a flange hose 76, to a second portion 36B of the interconnection module 36. This second portion 36B comprises inlet valves 77, a gas discharge feeder tank 78 and outlet valves 79. A quick-release hose 80 connects one of the outlet valves 79 to the transport network 10.

Outside this gas circuit, module 31 performs the functions of safety, management (pressure or flow rate regulation) and network stability 15, and module 34 performs the utility functions, in particular electrical power supply.

Two types of regulation envisaged for the compressor are described below. Flow rate regulation means that the flow rate going through the compressor is constant when the mobile backfeeding installation operates. However, it is the suction pressure (for example in a medium pressure network) which triggers the starting and stopping of the compressor when this pressure reaches threshold values set during step 54. FIG. 9 represents an example of the change in the pressure 90 upstream from the compressor and of the flow rate 91 of the compressor, in a case where the pressure threshold for starting the compressor is 4.2 bar and where the pressure threshold for stopping the compressor is 2.5 bar. When the pressure decreases between these two threshold values during the operation of the compressor, the automaton regulates the operation of the compressor so as to have a constant flow rate of 700 $Nm^3/h$.

In the case of pressure regulation, the flow rate going through the mobile backfeeding installation evolves such that the suction pressure (for example in a medium pressure network) stays constant. FIG. 10 shows an example of the change in the pressure 90 upstream from the compressor and of the flow rate 91 of the compressor with a pressure setpoint value upstream from the compressor of 4 bar, as a function of the flow rate 92 of the gas consumed by the consumers over the distribution network, of the flow rate 93 of the gas injected by biomethane producers over the distribution network. FIG. 10 also shows the flow rate 94 of gas supplied by the transport network.

FIG. 10 shows that, once the flow rate of the consumption over the distribution network is less than the biomethane injection flow rate, the delivery station stops injecting gas from the transport network and the automaton regulates the compressor so that the pressure of the distribution network is constant regardless of variations in consumption over the distribution network.

Where there are two compressors, a first compressor performs the operation of the backfeeding installation through to its operating limit. If necessary, the automaton orders the operation of a second compressor to supplement the flow rate of gas passing through the backfeeding installation.

In some embodiments, the compressor is driven by a gas motor from which all the hydraulic power required to power all the auxiliaries is drawn. The installation is thus completely independent and does not require connection to the electricity grid.

Figure 11:
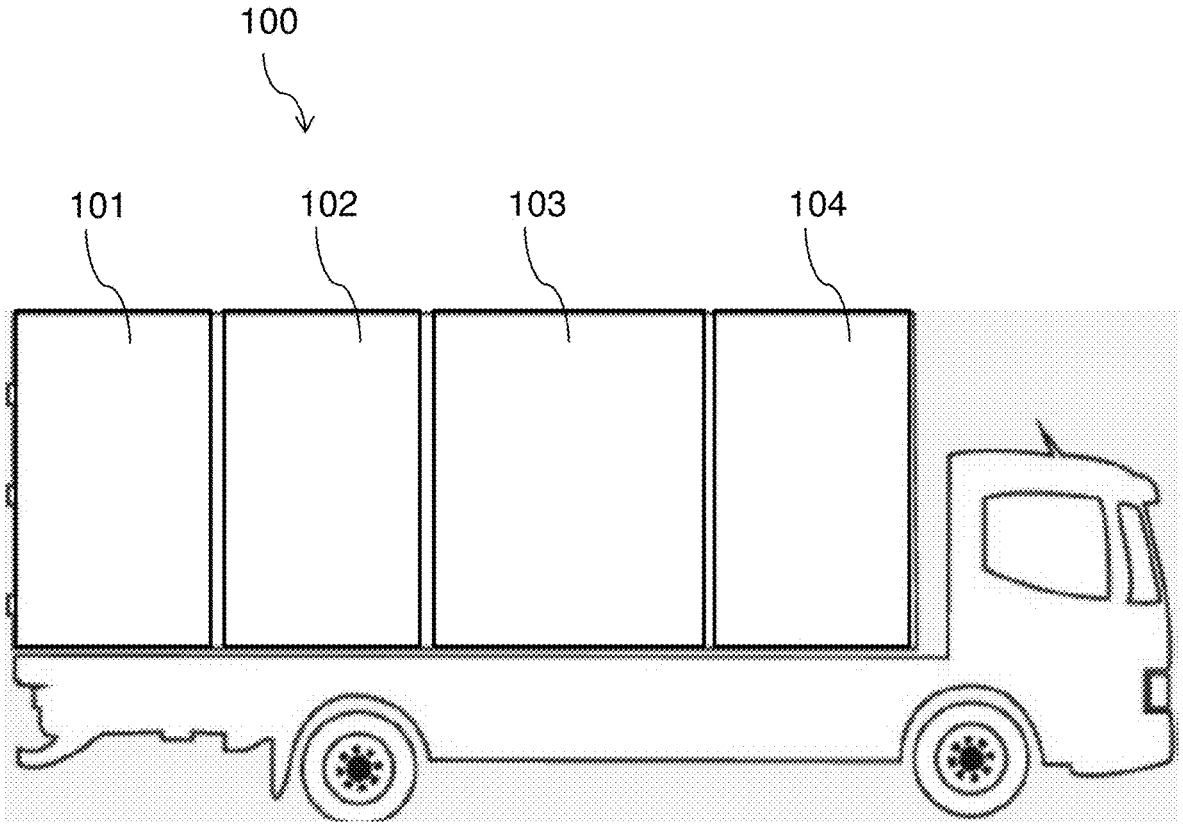
FIG. 11 represents a backfeeding installation that is the subject of the invention, mounted on a vehicle.

In some embodiments in which the backfeeding installation is transported on a truck or trailer, as in FIG. 11, preferably air coolers are placed behind, not on top of, the vehicle. The installation operations are therefore reduced since there is no crane operations for the air coolers. The backfeeding installation can be arranged as-is on the site for a long-term use, or the backfeeding installation can remain mounted on the truck or trailer during its operation.

The electrical cabinet in front is isolated from the rest of the installation and comprises in particular a 3G industrial router for telecommunications.

A mobile analysis laboratory comprising a shared chromatograph, for measuring the THT and the composition of the gas, and a hygrometer, for example a ceramic hygrometer, is incorporated into the backfeeding installation. The backfeeding installation can also incorporate a dehydration skid and a volumetric meter for billing.

Several backfeeding installations can be installed in parallel, especially for cases of low gas consumption and significant biogas injection over the distribution network.

Functional specifications of the mobile backfeeding installation:

- F1: Make possible the transmission of a finite volumetric flow rate of gas from the medium-pressure distribution network to the transport network at high pressure in off-peak periods;
- F2: Ensure the complete autonomy of the mobile backfeeding installation;
- F3: Ensure an absence of pressure variation for the distribution network;
- F4: Comply with the conformity specifications of the networks;
- F5: Comply with the quality specifications of the networks.

Note that the allowable water content on the GRT GAZ and GRDF networks are different. Despite the fact that the two networks have the same dew point, the absolute humidity level (expressed as $mg \cdot Nm^{-3}$) varies with the pressure. The allowable $CO_2$ and $O_2$ contents are also different. The specifications are listed in the following table:

| | Transport network | Distribution network |
|---|---|---|
| $O_2$ | <0.7% | <0.75% |
| $H_2O$ | <53.2 mg · $Nm^{-3}$ | <800 mg · $Nm^{-3}$ |
| $CO_2$ | <2.5% | <3.5% |

In addition, the temperature on output from the mobile backfeeding installation must not be lower than the recommendations applicable to the transport network. The transactional count covers the normal compressed flow rate, expressed in energy (kWh), from the HHV.

If the pressure of the medium pressure network tolerates a significant pressure range (in principle mainly 8 barG or 20 barG networks), then flow rate regulation can be performed. In that case, the pressure over the medium pressure network is kept within maximum and minimum bounds, not regulated. For the compressor, that means an operation in which the motor speed can be adapted for a fixed volumetric flow rate. If the distribution network does not tolerate pressure variations, pressure regulation can be chosen. In all cases, the pressure of the transport network is considered to be regulated as well.

Two solutions are possible. When a fixed compressor speed is wanted then, in particular to remain within its optimum operation range, a recycling device is utilized, which makes it possible to ensure a high pressure (on output from the compressor) greater than the pressure of the transport network. The normal flow rate at the compressor is constant. The pressure of the distribution network is regulated by a discharge device. Where the compressor accepts a variable speed, the pressure will be regulated by the motor speed of the motor that actuates the compressor. This solution requires the use of a frequency converter that controls the motor of the compressor.

The compressor can be a reversible piston compressor, more reliable and less fragile than a V-shape compressor. With this type of compressor, pressure regulation by motor speed variation can easily be envisaged. This motor can be a motor consuming gas collected from the distribution network at the first pressure.

Piston compressors allow very high compression ratios and great flexibility in their use. A piston compressor can start and operate at a flow rate close to zero. Horizontal piston compressors have, for example, pistons mounted in tandem. The compression chamber has a smaller area, which allows the compression ratio to be increased. A double-acting piston compresses the gas on the outward and return strokes. The compression chambers have equal areas. This configuration is more complex because the segments must be sealed on both sides. Such an arrangement of pistons makes it possible to increase the compactness of a compressor by multiplying the compression chambers.

Low-capacity compressors can be air-cooled, with a fan mounted directly on the shaft. For larger-capacity compressors, the gas is cooled in intermediate exchangers and a glycol-water circuit circulating in the liners of the compressors also cools the gas during compression.

It is preferable to have valve-control in series downstream from the compressor to make starting it easier. Without valve-control, the motor would need to overcome the backpressure of the network at a reduced speed, and in these conditions the motor torque could rise swiftly. Regardless of the solution chosen for regulating the network, a discharge device or a valve downstream from the compressor is recommended for starting the machine.

With regard to the motorization, gas motorization makes it possible to ensure the presence of an energy source irrespective of the location considered. The motors are industrial types.

Several alarms are implemented on the backfeeding installation:

- THT content below the mandatory threshold downstream from the dehydrator;
- Water content abnormally high upstream from the dehydrator;
- Water content higher than the recommended threshold over the transport network downstream from the dehydrator;
- Quality above specifications of the gas upstream.

Transactional metering is on an energy basis. This energy is the product of the HHV (expressed in kWh/Nm$^3$) by the standardized volumetric flow rate.

The volumetric flow rate measurement instruments do not provide the standardized measurement. To make the link, we use the relationship:

$$D_{v,0} = D_v \cdot \frac{Z_0}{Z_1} \cdot \frac{P_1}{P_0} \cdot \frac{T_0}{T_1}$$

Where the subscript 0 represents the conditions at the baseline status and the subscript 1 the suction conditions.

The correlation calorimeters can only operate for an already-known type of gas (natural or biomethane) and must therefore be preset. This is because the algorithm that deduces the HHV based on the conductivity measurement and a calibration curve cannot work on a large range of compositions covering natural gas and biomethane.

However, at the location where the mobile backfeeding installation is used, the gas is a mixture of natural gas and biomethane and thus it is impossible to predict its composition. Preferably, the mobile backfeeding installation comprises a means for obtaining the composition of the gas. The composition of the gas is analyzed using a chromatograph.

The device can comprise a pneumatic analysis box and a separate electrical box comprising the electronic components for processing data. The electrical box can be transferred to the electrical cabinet whereas the pneumatic analysis box is incorporated into an air-conditioned laboratory protected from vibrations, mounted on the mobile backfeeding installation.

Incorporating and using a chromatograph on a mobile device is complex. To overcome the problem, the analysis can be transferred:

To the expansion station or backfeeding unit, if nearby and equipped, or

To the laboratory, at a later time.

In the last case, the trailer of the mobile backfeeding installation is equipped with a system for storage in bottles. The gas is collected at regular intervals by an automated system (pneumatic valves).

For the THT measurement, the mobile backfeeding installation is equipped with a single analyzer, downstream from the dehydrator.

The analyzer of the composition of the gas and of the THT (TetraHydroThiophene) content is preferably a single machine. This solution is currently being tested with a view to obtaining authorization for the network. Preferably, the mobile backfeeding installation includes a laboratory that is air-conditioned and protected from shocks and vibrations, a laboratory that comprises at least one chromatograph Preferably, a quartz-crystal hygrometer or a ceramic sensor is utilized.

Each compression stage is equipped with a pressure-relief valve. If these pressure-relief valves are connected to the distribution networks, the influence of the back-pressure on the flow rate coefficient calculation is taken into account. The taring of the pressure-relief valves for discharge is MOP (67.7)+6% maximum. The taring of the pressure-relief valves for suction is storage pressure+6%.

The backfeeding installation comprises a fire control unit, with detector and extinguisher, and gas detection. The electrical cabinet is isolated from the compressor by a wall comprising sealed bulkhead fittings.

The architecture of a mobile backfeeding installation mounted on a vehicle 100 is shown in FIG. 11. The vehicle 100 is a truck or a trailer that is fitted-out, containerized, pre-assembled and comprising all the functions (motor-compressor and its auxiliaries, cooling circuit with fan, transactional metering, instrumentation and industrial computer).

The gas motor is supplied by the lowest pressure gas network, to avoid expanding the gas that one seeks to compress using the backfeeding unit. The rear portion 101 comprises the air coolers. The next portion, 102, comprises the gas motor and an air filter. The compressor is in the portion 103, with its auxiliaries. The front portion 104 comprises the other functions of the mobile backfeeding installation (in particular gas analysis, metering, dehydration, remote communication, fire control unit and control automaton).

In this embodiment, there is a direct motor-compressor coupling, an isolated electrical cabinet (in portion 104), a water cooling circuit, a primary energy extraction on the compressor by means of a hydraulic system for powering the main compressors (in particular fans and pumps), a battery linked to the motor of the vehicle and to the motor of the compressor for powering electronic auxiliaries (in particular sensors and electrical cabinets), fan included. The main energy source is natural gas. The list of consuming items comprises the auxiliaries of the compressor, the fans, the air cooler, the water pump of the compressor, the auxiliaries of the motor, the lubrication oil pump, the electrical oil-heater, the command/control, the 24-volt alternator and the control systems.

The low-consumption items (especially the control unit, lighting, instrumentation, gas metering and quality) are powered by a 24V alternator connected to a battery. This battery is supplied by the gas motor. It is also connected to the motor of the truck so that the control units are immediately operational after transport.

The cooling circuit, fan and lubrication of the motor are powered by a hydraulic system whose power is drawn directly from the motor.

Pressure regulation is carried out via the servomotors of the regulators. The service valves are manual because it is not necessary to isolate the compressor of the network when the machine is stopped. The installation does not have actuators, thus reducing consumption. In some embodiments with actuators, a hydraulic or pneumatic supply is preferred. These actuators consume nothing when stopped (unlike electric actuators, which maintain a current at their terminals so that the springs do not close).

Preferably, the compressor allows the number of compression stages to be adapted automatically to the conditions on input. When the upstream pressure is high, all the stages of the compressor are simultaneously supplied so as to increase the flow rate. Conversely, when the upstream pressure is lower and the required pressure ratio is greater, the compression is stepped with possible intermediate cooling. This system improves the compressor's adaption to the operating conditions. It makes it possible to avoid using a pre-expansion valve (which reduces the overall performance levels of the system) over a broader pressure range. With this solution, the compressor can quickly reduce the pressure of the distribution network (if it is very high) while in the first operating mode. Once the pressure has dropped to a certain predefined value, the compressor passes on to the second operating mode, to ensure the required compression ratio.

The invention claimed is:

1. Backfeeding installation, comprising:

modules comprising the following functions:

at least one compressor for compressing gas, an automaton for controlling the operation of at least one compressor, at least one sensor for checking the quality compliance of the gas circulating in the compressor, at least one meter for metering a flow rate of gas circulating in the compressor, and at least one filter for filtering the gas circulating in the compressor; and an interconnection module for interconnection between the other modules and with a gas network at a first pressure and a gas network at a second pressure higher than the first pressure; in which at least one of these modules is mobile, configured to be transported, in its entirety and operational by means of a removable connection to the interconnection module and to a power source, on a single vehicle.

2. Backfeeding installation according to claim 1, wherein all modules of the backfeeding installation are mobile, configured to be transported, in their entirety and operational by means of a removable connection to the interconnection module and to a power source, on a single vehicle.

3. Backfeeding installation, according to claim 1, which comprises a mobile stand-alone electric power source.

4. Backfeeding installation according to claim 3, wherein the mobile electric power source is a generator put into operation by a vehicle motor.

5. Backfeeding installation according to claim 3, wherein the electric power source is a motor fueled with gas at the first pressure.

6. Backfeeding installation according to claim 1, wherein at least one module comprises a gas detector and/or a fire detector.

7. Backfeeding installation according to claim 1, wherein at least one compressor is actuated mechanically by a vehicle motor.

8. Backfeeding installation according to claim 1, wherein the interconnection module comprises:

a mobile distribution unit for distributing gas from a gas network at a first pressure to several modules by means of an interface; and a mobile collection unit for collecting the gas from each said module at a second interface.

9. Backfeeding installation according to claim 1, wherein the automaton is configured to control the operation of a plurality of compressors as a function of the compression capacity of the operational compressors.

10. Backfeeding installation according to claim 1, which also comprises at least one recycling circuit equipped with a valve, configured to expand the gas exiting from a compressor and inject it upstream from or at the inlet of said compressor when at least one compressor is put into operation, the automaton being configured to control the operation of the valve of the recycling circuit as a function of the compression capacity of the operational compressors that are put into operation jointly.

11. Backfeeding installation according to claim 1, wherein at least one module of the backfeeding installation is incorporated into a standard container.

12. Backfeeding installation according to claim 1, which comprises a mobile analysis laboratory that is air-conditioned and protected from shocks and vibrations, this laboratory including a shared chromatograph to measure the THT and the composition of the gas.

13. Backfeeding installation according to claim 1, which comprises a correlation calorimeter utilizing the gas composition obtained by a chromatograph.

14. Backfeeding installation according to claim 1, which comprises a hygrometer, for example a ceramic hygrometer.

15. Backfeeding installation according to claim 1, which comprises a dehydration skid and a volumetric meter.

16. Backfeeding installation according to claim 1, which comprises a means for valve-control in series downstream from at least one compressor.

17. Backfeeding installation according to claim 1, which comprises a discharge device in series, downstream from at least one compressor.

18. Backfeeding installation according to claim 1, which comprises a system for storing gas in bottles, and a means for sampling the gas at different times, for example using pneumatic valves.

19. Backfeeding installation according to claim 1, which comprises a fire control unit, with detector and extinguisher, and a means for detecting gas.

20. Backfeeding installation according to claim 1, which comprises an electrical cabinet isolated from each compressor by a wall comprising sealed bulkhead fittings.

* * * * *